US005551809A

United States Patent [19]

Forsberg

[11] Patent Number: 5,551,809

[45] Date of Patent: Sep. 3, 1996

[54] EMBANKMENT WALL CONSTRUCTION AND METHOD AND BLOCK CONSTRUCTION FOR MAKING THE SAME

[75] Inventor: Paul J. Forsberg, Wayzata, Minn.

[73] Assignee: Keystone Retaining Wall Systems, Inc., Edina, Minn.

[21] Appl. No.: 298,415

[22] Filed: Aug. 30, 1994

[51] Int. Cl.[6] ..... E02D 17/20

[52] U.S. Cl. ..... 405/285

[58] Field of Search ..... 405/284, 285, 405/256; 52/586, 609

[56] References Cited

U.S. PATENT DOCUMENTS

| | | | |
|---|---|---|---|
| 4,512,685 | 4/1985 | Hegle | 405/285 X |
| 4,802,320 | 2/1989 | Forsberg . | |
| 5,161,918 | 11/1992 | Hodel | 405/286 |
| 5,257,880 | 11/1993 | Janopaul Jr. | 405/286 X |
| 5,425,600 | 6/1995 | Gordon | 405/286 X |

*Primary Examiner*—William P. Neuder
*Attorney, Agent, or Firm*—Dorsey & Whitney LLP

[57] ABSTRACT

An embankment wall construction and a method for constructing the same in which the construction includes a base, a sloping wall formed of a plurality of precast modular units assembled in rows with each row setback from an adjacent lower row to form a slope angle of 30° to 75°. The present invention also relates to a modular unit configuration for use in constructing the embankment wall of the present invention.

30 Claims, 3 Drawing Sheets

EMBANKMENT WALL CONSTRUCTION AND METHOD AND BLOCK CONSTRUCTION FOR MAKING THE SAME

BACKGROUND OF THE INVENTION

1. Field of the Invention

The present invention relates generally to an embankment wall construction to provide a low maintenance slope surface for erosion control or directing and controlling the flow of water. More particularly the present invention relates to a reinforced wall, slope or water control channel having a slope angle of 30° to 75°. The present invention also relates to a method of constructing the slope or water control channel using precast, mortarless blocks or modular units and an improved block configuration for use in such construction.

2. Description of the Prior Art

Several methods currently exist for constructing water and erosion control channels and reinforcement slopes. One method involves a technology referred to as slope paving. Slope paving involves the pouring of concrete into concrete mold forms which define a base and a pair of sloping sidewalls or pouring low slump concrete directly onto the embankment slope without forms. With slope paving, however, several disadvantages exist. First, the permissible slope of the sidewalls is limited. Slope paving generally attempts to match the sidewall slope with the stable slope of the surrounding soil. This is commonly in the range of about 15° to 25°. Construction at a slope greater than this angle creates a danger of wall collapse. Second, soil which is adjacent to the sloped sidewalls cannot be fully compacted. This often results in undermining and erosion and, in some cases, the possibility of wall collapse. Third, slope paving is limited to the construction of relatively smooth wall surfaces. In some cases, this may preclude someone who may have accidently fallen into the channel from being able to get out safely, without assistance.

A further technique currently used to construct water control channels or reinforcement slope structures involves the use of fabric formed concrete revetment mats or the use of relatively large concrete panels laid directly onto a slope and tied together with cables or the like. However, these have many of the same limitations as slope paving including limited sidewall slope and limited soil compaction adjacent to the sidewall.

A third technique used to construct water control channels or reinforcement slope structures involves the use of rock filled wire baskets which are commonly referred to as gabions. With this technique, rock filled baskets are stacked in a semivertical or batteredback fashion. The wire baskets ordinarily do not employ external anchoring means. Instead, they provide stability principally as a result of gravity (i.e.) the weight of the rocks within the wire baskets. Although this method provides an acceptable and durable face and is reasonably stable, construction of such a wall is labor intensive. Further, this technique requires a large supply of fairly large rocks. Such rocks are not always available, and even when they are, they can be prohibitively expensive. Still further, because of the potential corrosion of the wire baskets, this technique is not entirely maintenance free.

Another method of constructing slopes involves the use of matrices of synthetic geogrid type material in which layers of such material are placed horizontally on excavated portions of the slope. These layers extend rearwardly from the face of the slope and, after the excavation has been backfilled, serve to stabilize the slope. This technique, however, relies on effective compaction of the soil mass. This is difficult to achieve, particularly for steep slopes in the vicinity of the slope face since the soil in that area is not laterally constrained. Further, geogrid reinforced slopes are subject to surface erosion due to the lack of a facing element.

Accordingly, a principle limitation of slope paving and the use of fabric revetment or concrete panels is that they must be laid onto a stable slope. This limits the sidewall slope to less than 30°, and more typically to a slope of about 15° to 25°. In the case of a water control channels, this increases the channel width or "footprint" needed to carry a given volume of water flow. Although the use of gabions facilitates walls with steeper slopes, such technique also has limitations as discussed above.

Accordingly, there is a need for a cost efficient reinforcement slope or water control channel construction and a method of making the same which overcomes the above limitations. More specifically, a need exists for an embankment wall having a slope angle greater than 30° and which facilitates improved compacting adjacent to the sidewalls.

SUMMARY OF THE INVENTION

In contrast to the prior art, the present invention provides for an improved embankment wall construction and a method and module construction for making the same. More particularly, the present invention relates to a reinforcement slope or water control channel constructed of precast, mortarless blocks or modules which are capable of forming an embankment wall with a wall construction at a slope of greater than 30° from the horizontal and which facilitates compaction of the embankment soil adjacent to the wall. In accordance with the present invention, the individual precast modules are provided with interconnect means to provide the modules with a setback capability sufficient to form a slope less than about 75° and greater than about 30°. The construction of the present invention also preferably includes tieback means associated with selected courses or rows of modules to assist in stabilizing the wall structure and anchoring the same into the embankment. Although the use of precast retaining wall blocks are well known for use in constructing retaining walls having a slope greater than 75° and more typically in the range of 85° to 90°, use of such blocks have not been heretofore used in the construction of reinforcement slopes or water control channels defined by walls having a slope less than 75°, but greater than 30°. Accordingly, conventional retaining walls are distinguishable from the embankment walls of the present invention.

In one embodiment of the present invention, a water control channel or reinforcement wall is constructed of individual precast modules having a front face disposed at a 90° angle with the top surface to enable a person or animal who may have accidentally or otherwise fallen into the channel to walk or climb out without assistance. In a second embodiment, the individual precast modules are provided with a front face which is beveled at an angle at least approximately congruent to the setback angle of the slope so that when assembled, the wall has a substantially flat, continuous surface.

Accordingly, it is an object of the present invention to provide an improved reinforcement slope or water control channel which is constructed of precast modules.

Another object of the present invention is to provide a reinforcement slope or water control channel with walls sloped at greater than about 30° from the horizontal while still being sufficiently stable to prevent collapse.

A further object of the present invention is to provide a wall for a reinforcement slope or water control channel having improved edge compacting.

A still further object of the present invention is to provide a reinforcement slope or water control channel from which a person or animal can walk or climb without assistance.

Another object of the present invention is to provide a method for constructing a reinforcement slope or water control channel of the type described above.

A still further object of the present invention is to provide an improved modular unit for use in constructing a water control channel or reinforcement slope structure of the type described above.

These and other objects of the present invention will become apparent with reference to the drawings, the description of the preferred embodiment and method and the appended claims.

DESCRIPTION OF THE PREFERRED EMBODIMENT

The preferred embodiment of the present invention relates to waterway, canal or channel construction which can be used for erosion control, irrigation or other water supply, flood control, drainage, water removal, diverting or containing natural streams and waterways, or the like. In the present application these structures will be referred to in the aggregate as water control channels. The present invention also relates to a reinforced slope comprised of a single wall having a wall slope of less than about 75° and greater than about 30°. Although the present invention is applicable to both structures, the preferred embodiment will be described with respect to a water control channel. It is understood, however, that the structure of a reinforced slope will be similar to one sidewall of the water control channel. The term embankment wall structure or construction is used herein to cover both such embodiments.

Figure 1:
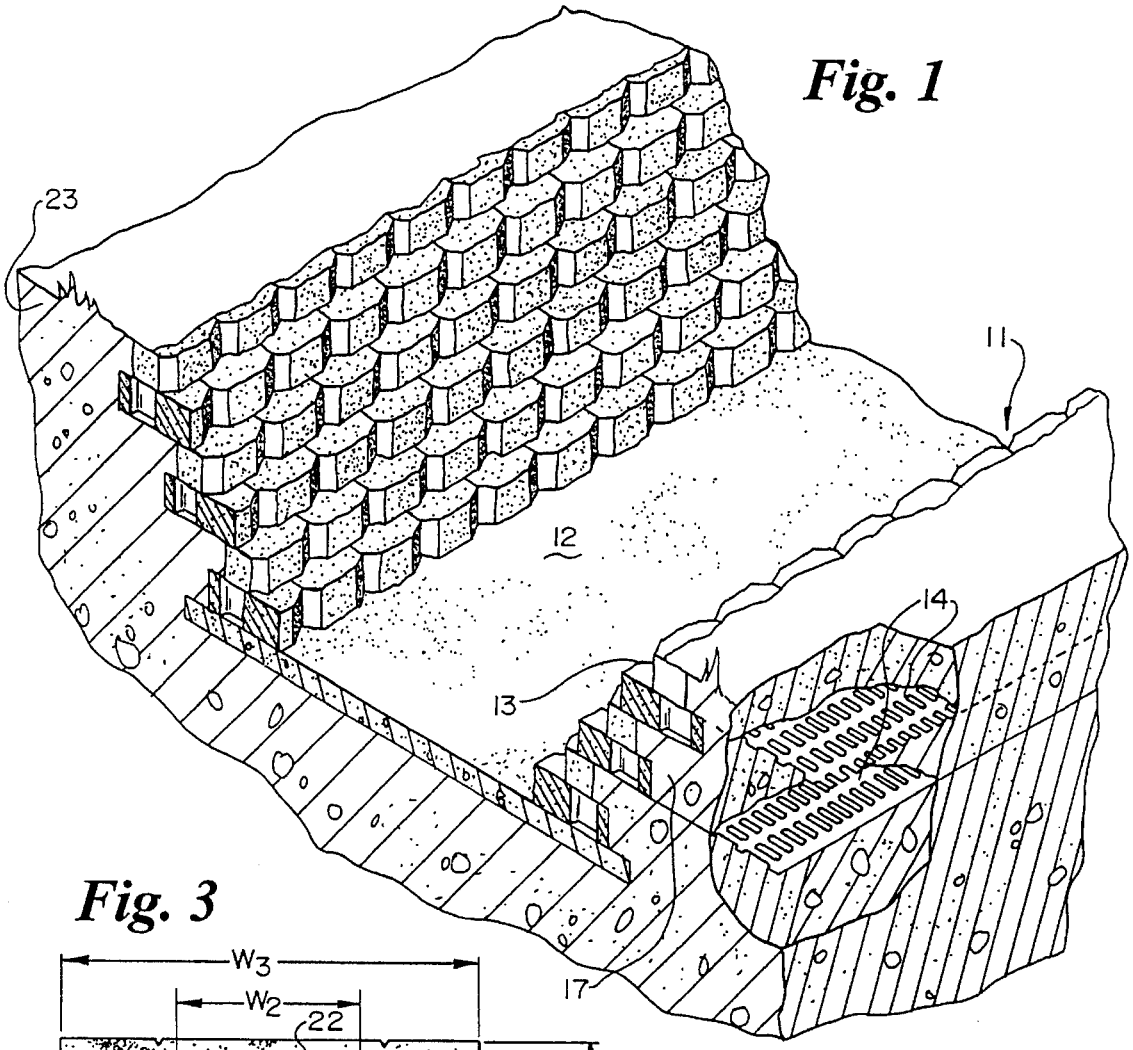
FIG. 1 is a perspective view of a water control channel constructed in accordance with the present invention.

Reference is initially made to FIG. 1 illustrating a man-made water control channel comprising a pair of sloped sidewalls 10 and 11. Each of the sidewalls 10 and 11 extend at a slope upwardly and rearwardly from a centrally positioned channel base or bottom. The base or bottom can include a concrete slab 12 or the like such as illustrated in FIG. 1 or, in many cases, can merely comprise compacted soil. In the case where a separate man-made bottom is not needed, the bottom of the sidewalls 10 and 11 rest directly onto the compacted soil or onto some other footing if desired. In addition to concrete or packed soil bottoms, the water control channel bottom can also be formed of rip rap in the form of rocks or boulders to eliminate erosion during water flow. The particular type of bottom will depend principally on the type of water flow the channel is intended to contain. If higher flow rates are anticipated, a bottom formed of concrete, rip rap or some other erosion resistant material will generally be required. For applications involving minimal flow, compacted soil will generally be sufficient.

Each of the sidewalls 10 and 11 is constructed of a plurality of precast modules or modular units laid adjacent to one another to form generally horizontal rows and a plurality of rows positioned one on top of the other. Each succeeding row is set back from the adjacent lower row so as to form a wall which slopes upwardly and away from the opposing sidewall as illustrated in FIG. 1. Preferably the slope of each of the sidewalls 10 and 11 is about 30° to 75° from the horizontal, more preferably about 40° to 70°, and most preferably about 45° to 60°. The particular slope angle of the sidewall is a function of the height or thickness of the module and the distance each row is set back from the adjacent lower row. Further, each sidewall 10 and 11 includes an inner surface 13 defining a flow channel and an outer surface 17 engaging an adjacent embankment 23.

In the preferred embodiment, adjacent modules in a row and adjacent rows are interlocked together by a variety of interlocking techniques known in the art. For example, as described below and as illustrated best in FIGS. 2, 5 and 6, the preferred embodiment of the present invention contemplates a pin connection mechanism. However, other pin interlock mechanisms as well as pinless interlock mechanisms can be used to construct the water control channel in accordance with the present invention.

Tieback or other means 14 for anchoring the sidewalls 10 and 11 into the adjacent embankment are used to stabilize the walls 10 and 11 and to resist forces arising from hydrostatic or other pressures. Examples of tieback means include geogrid type materials.

Figure 3:
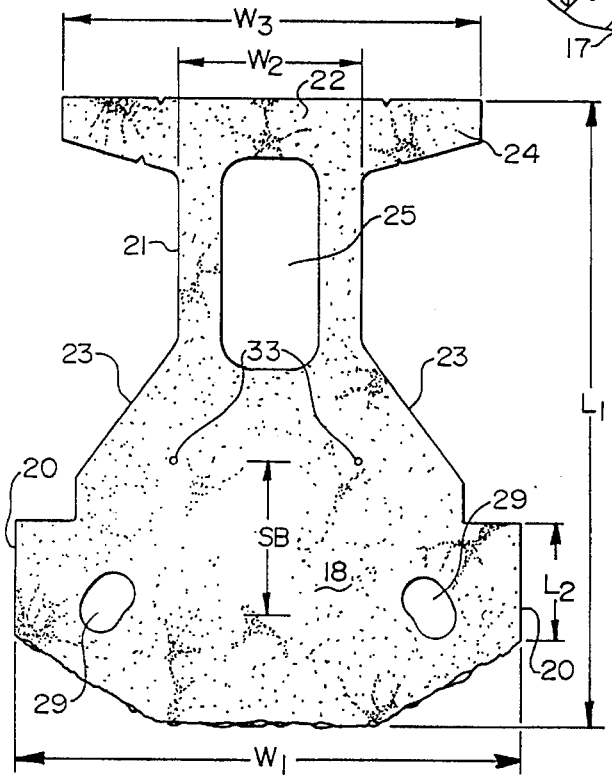
FIG. 3 is a bottom elevational view of the modular unit illustrated in FIG. 2.
Figure 2:
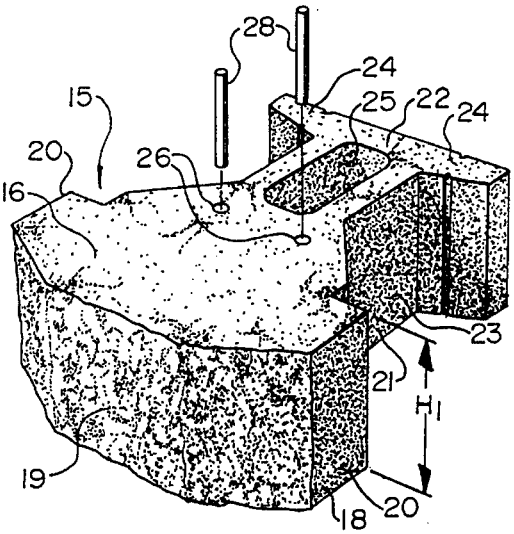
FIG. 2 is a perspective view of one embodiment of a modular unit used to construct the water control channel or reinforcement slope structure of the present invention.

FIGS. 2 and 3 illustrate one embodiment of a precast module 15 for use in construction of the water control channel of the present invention. The module 15 of FIG. 2 includes a pair of flat, equally spaced top and bottom surfaces 16 and 18, respectively. When installed, the top and bottom surfaces 16 and 18 are vertically spaced from one another. The module 15 includes a front or forward end defined by a front face 19 and a pair of sidewalls 23, 23 extending rearwardly from the front face 19 to the rearward end. The sidewalls 23, 23 include sidewall portions 20, 20 adjacent to the front face 19. The module also includes a narrow neck or central portion 21 and a back or rearward end. The rearward end is defined by the tail portion 22 which includes a pair of laterally extending ear portions 24. The neck 21 preferably includes an opening 25 to reduce the overall weight of the module.

Figure 5:
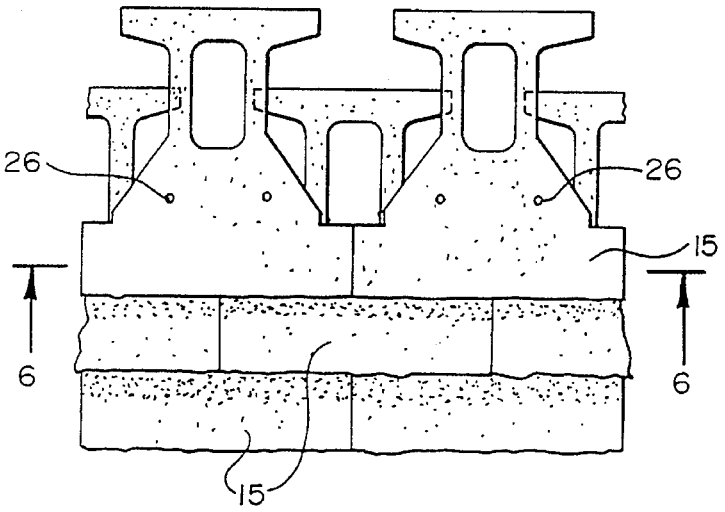
FIG. 5 is an elevational plan view of a plurality of the modules of FIG. 2 shown in their assembled form.
Figure 6:
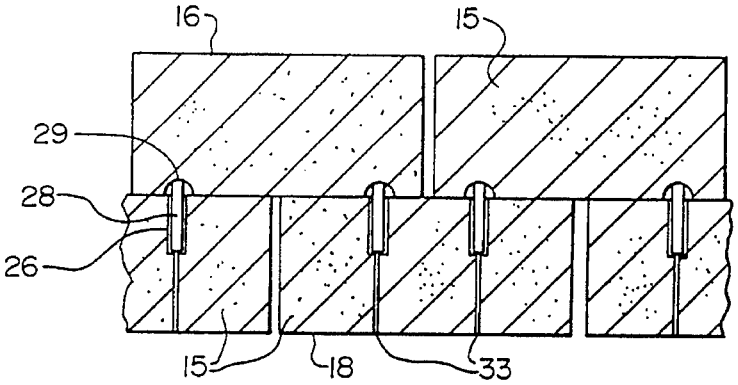
FIG. 6 is a view, partially in section, as viewed along the section line 6—6 of FIG. 5.

For the module of FIGS. 2 and 3 to function in accordance with the present invention, several structural relationships are preferred although not necessarily required. First, the sidewall portions 20, 20 adjacent to the front face 19 are preferably parallel to one another. Thus, when the modules are assembled into a wall structure as shown in FIGS. 1 and 5, the sidewall portions 20, 20 of adjacent blocks mate with one another to eliminate or minimize any gap between them. Secondly, the length of the sidewall portions 20, 20 defined by the dimension $L_2$ and measured in a direction extending from the front face 19 to the rearward end 22 is preferably sufficiently long to allow an adjacent upper row of modules to be set back the desired distance without exposing the inner sidewall ends. If the existence of a gap between adjacent sidewalls is of no concern, the sidewalls can be angled inwardly toward the rearward end.

As shown in FIG. 3, lateral dimensions defining the width of the front face 19 ($W_1$), the width of the neck 21 ($W_2$) and the width of the tail 22 ($W_3$) are measured in a direction perpendicular to the length dimensions of the module. In the preferred structure of the present invention, the width of neck ($W_2$) is less than one-half the width of the face ($W_1$) and the sum of neck width ($W_2$) and the tail width ($W_3$) is greater than the face width ($W_1$). With this latter relationship, the neck 21 of the modules in each row will be supported by the ear portions 24 of an adjacent lower row when assembled. This is shown best in FIG. 5. Further, the length of the modules ($L_1$) is preferably greater than the width of the front face ($W_1$). The setback of each successive row of modules is defined by the dimension SB between the pockets 29 and the holes 33 as shown in FIG. 3. The slope angle of the embankment wall is determined by the setback SB compared to the height or thickness $H_1$ (FIG. 2) of the module.

Figure 4:
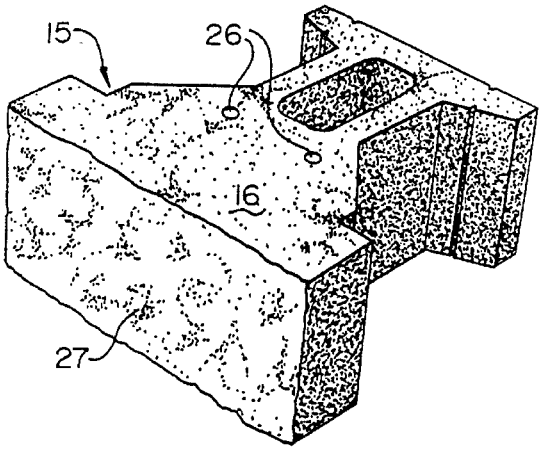
FIG. 4 is a perspective view of an alternate modular unit useful in constructing a water control channel in accordance with the present invention.

The embodiment of FIGS. 2 and 3 shows the front face 19 as comprising a three plane, split rock decorative face, however, it is contemplated that a variety of front face configurations can be used. Thus, the front face 19 can be provided with a three plane, split rock face as illustrated in FIG. 2 or can be provided with a substantially straight front face 27 as illustrated in the embodiment of FIG. 4. A water control channel or canal constructed of the modules of FIG. 2 will have a somewhat decorative appearance, while a water control channel constructed of the modules of FIG. 4 will have a stepped configuration.

With continuing reference to FIG. 2, the top surface 16 of the module 15 is provided with at least one, or more pairs of pin receiving holes 26, 26. These holes 26, 26 are adapted for receiving a pair of pins 28, 28 for interlocking adjacent modules and adjacent rows of modules together. The bottom of the module of FIG. 2 is illustrated best in FIG. 3 and is shown to include a pair of kidney shaped pockets or openings 29, 29 to receive the upper ends of the pins 28, 28 when one module is laid upon another. Preferably the pockets 29, 29 extend from the module bottom and partially through the module. The bottom surface also includes a pair of holes 33, 33 which are an extension of the holes 26, 26, but smaller in diameter. The module of FIG. 4 is also provided with similar pockets and holes on its bottom surface.

FIG. 5 shows a plurality of adjacent modules and a plurality of rows of adjacent modules in their assembled form, with each adjacent row of modules set back from the lower adjacent row a distance sufficient to provide the desired wall slope of about 30° to 75°, more preferably 40° to 70° and most preferably about 45° to 60°. The specific set back shown in FIG. 5 provides a sidewall slope of about 55°. Each module can be used to build slopes of varying set backs. This is accomplished by providing multiple sets of pin receiving openings as illustrated in FIG. 2. The alternate pin positions allow construction of more than one set back angle. As illustrated in the sectional view of FIG. 6, each of the pin receiving openings 26, 26 is enlarged at its top end to receive the pins 28, 28, but reduced in diameter at its lower end to form the opening 33. This particular configuration prevents the pins 28, 28 from falling entirely through the module, while still allowing drainage of water through the holes 33, 33. This form of pin connection is well known in the art as shown in U.S. Pat. No. 4,914,876, the substance of which is incorporated herein by reference.

The tie back or anchor means 14 (FIGS. 1 or 9) can be any of a variety of retaining wall tieback means known in the art. The preferred embodiment contemplates tie back means such as that shown in the above identified U.S. Pat. No. 4,914,876, the substance of which is incorporated by reference.

Figure 7:
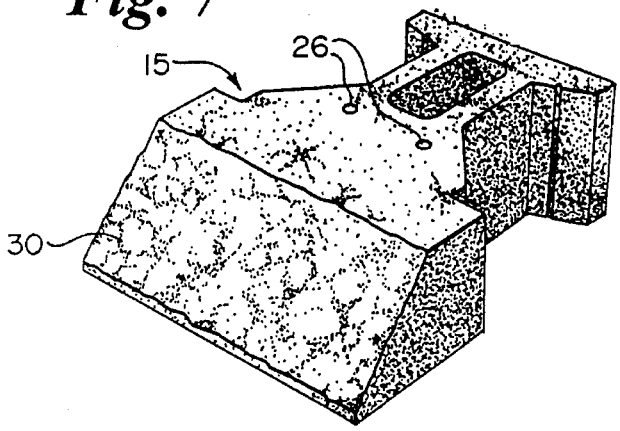
FIG. 7 is a perspective view of an alternate modular unit in accordance with the present invention.
Figure 8:
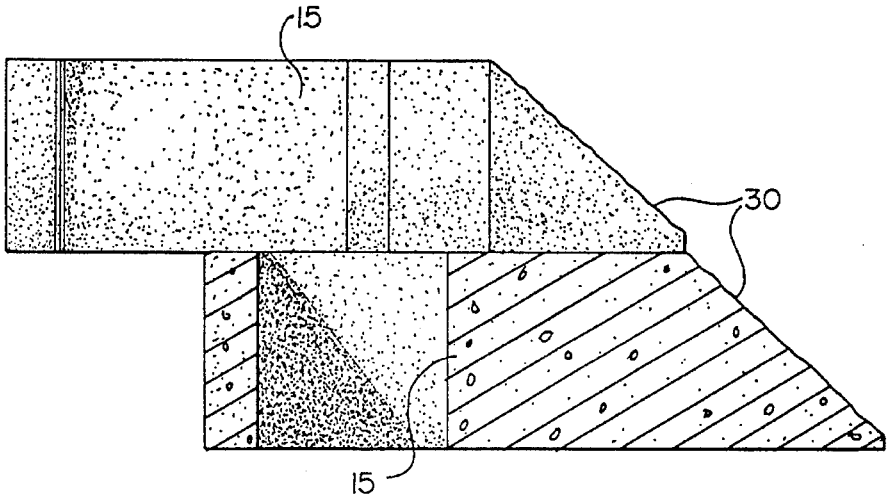
FIG. 8 is a side elevational view of a pair of modules, one on top of the other, of the type illustrated in FIG. 7.

FIGS. 7 and 8 illustrate a further embodiment of a precast module having particular applicability in the construction of a water control channel. The principal difference between the module of FIGS. 7 and 8 and the module of FIGS. 2 and 4 is that the front face 30 of the module of FIGS. 7 and 8 is beveled upwardly and rearwardly from the bottom surface 18 so that the face angle of the bevel matches the wall slope resulting from the setback of adjacent rows of modules. Such bevel is defined by the ratio of the setback relative to the height or thickness of the modules. When fully assembled, the front faces of adjacent modules and adjacent rows of modules of FIGS. 7 and 8 form a continuous sloping surface of a constant slope.

Figure 9:
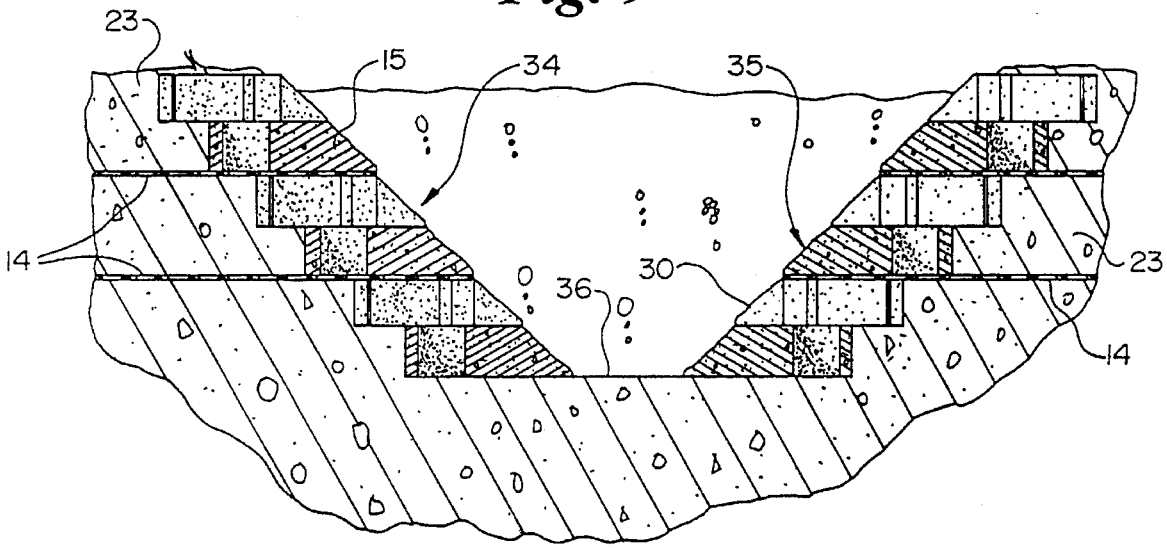
FIG. 9 is a view, partially in section, showing the module of FIG. 7 in assembled form to construct a water control channel.

Thus, a water control channel or slope structure built with modules of the type illustrated in FIGS. 7 and 8 results in sidewalls or slopes which are smooth and continuous, thereby substantially simulating a surface formed via slope paving or via fabric or concrete panel construction of the prior art. A water control channel formed with modules of FIGS. 7 and 8 is illustrated in FIG. 9 showing sidewalls 34 and 35 with a slope defined by a continuously beveled surface. Such a surface is often desired for certain applications, particularly where higher flow rates are anticipated. Sidewalls having such a construction generate less frictional resistance to water flow because of their smooth and continuous surface and thus are better suited for such high flow applications. The preferred bevel of the front face 30 is from about 30° to 75°, more preferably 40° to 70° and most preferably about 45° to 60°. It should also be noted that the water control channel of FIG. 9 is built with a base or bottom comprised of compacted soil 36, although alternatives such as poured concrete, erosion control mats or other techniques commonly known in the art might be employed.

Having described the structural details of the water control channel or slope and the modules for forming the same, the method aspect of the present invention can be understood as follows. First, the bottom or base of the channel is formed. In some cases, such as shown in FIG. 9, the base 36 can comprise compacted soil. In other cases such as illustrated in FIG. 1, and particularly where high flow is anticipated, a bottom of concrete 12, rip rap or other material can be provided.

Next, successive rows of precast modules are laid, with each row comprising a plurality of adjacent modules. Each of the adjacent modules in individual rows as well as each of the adjacent rows are tied together by means known in the art. Preferably, the adjacent modules in a single row are tied together as a result of the overlapping of modules in an adjacent row as shown in FIG. 5 and the interlocking of such adjacent rows through pins or other connection means. The modules are backfilled with suitable materials such as angular crushed rock or other free draining, compactable materials. The backfill is compacted as new courses of modules are added. Periodically during the construction of each of the sloping sidewalls, tieback or anchoring means 14 are provided, using techniques well known in the art for geogrid steel reinforcement of wall structures. Such tieback means will normally be provided every 3–7 rows depending upon a variety of factors including the slope of the wall, the height of the wall, the characteristics of the adjacent soil and the anchoring capacity of the anchor means being used.

Although the description of the preferred embodiment has been quite specific, it is contemplated that various deviations can be made to the preferred embodiment without deviating from the scope of the present invention. Accordingly, it is intended that the scope of the present invention be dictated by the appended claims rather than by the description of the preferred embodiment.

I claim:

1. An embankment wall structure comprising:

a wall having a lower end supported on a support surface, said wall extending upwardly from said support surface at a slope angle of about 30° to 60° from the horizontal;

said wall formed of a plurality of precast modules, said modules arranged in a plurality of horizontal rows positioned one on top of the other as said wall extends upwardly from said support surface, with each row having a plurality of modules in immediate, substantially touching, adjacent relationship throughout the entire length of said row and each row being in set back position relative to an adjacent lower row wherein said set back position is sufficient to provide said slope angle, said modules in any one row further being positioned so that each module in said one row bridges a first pair of adjacent modules in an adjacent higher row and a second pair of adjacent modules in an adjacent lower row; and interlock means comprising pin connection means associated with each module to interlock said plurality of modules and said plurality of rows in said set back position, said interlock means effective to interlock each module directly with said first pair of adjacent modules in the adjacent higher row and said second pair of adjacent modules in the adjacent lower row.

2. The embankment wall structure of claim 1 including tie-back means for anchoring said wall into adjacent soil.

3. The embankment wall structure of claim 2 wherein said tie-back means comprises sheets of geogrid type material.

4. The embankment wall structure of claim 1 wherein said slope angle is about 40° to 60° relative to the horizontal.

5. The embankment wall structure of claim 1 wherein said slope angle is about 50° to 60°.

6. The embankment wall structure of claim 1 wherein each of said plurality of modules includes top and bottom surfaces spaced from and parallel to each other and a front face substantially perpendicular to and joining said top and bottom surfaces whereby said wall is provided with a stepped exterior surface.

7. The embankment wall structure of claim 1 wherein each of said plurality of modules includes top and bottom surfaces spaced from each other and a front face joining said top and bottom surfaces and disposed at a front face angle relative to said bottom surface, said front face angle approximating said slope angle.

8. A water control channel construction comprising a pair of opposed and horizontally spaced sidewalls, each comprised of the embankment wall structure of claim 1, each of said side walls sloping away from one another as they extend upwardly, whereby each of said side walls include an exterior surface defining a flow channel and an interior surface engaging an adjacent embankment.

9. The water control channel construction of claim 8 wherein said support surface comprises compacted soil.

10. The water control channel construction of claim 8 wherein said support surface comprises a concrete slab.

11. The embankment wall structure of claim 1 wherein each of said plurality of modules includes top and bottom surfaces spaced from each other, a front face joining said top and bottom surfaces and having a pair of side edges and a pair of sidewalls extending rearwardly from said side edges and positioned between said top and bottom surfaces.

12. The embankment wall structure of claim 11 wherein said sidewalls include portions parallel to one another.

13. The water control channel of claim 8 wherein each of said plurality of modules includes top and bottom surfaces spaced from each other, a front face joining said top and bottom surfaces and having a pair of side edges and a pair of sidewalls extending rearwardly from said side edges and positioned between said top and bottom surfaces.

14. The module of claim 9 wherein said face angle is equal to said slope angle.

15. A precast construction module to be used with a plurality of other said modules to form a row and a plurality of said rows to form an embankment wall having a slope angle ranging from 30° to 75° relative to the horizontal, said module comprising:

spaced top and bottom surfaces each having a front edge;

a front face having top and bottom edges and a pair of side edges, said front face extending between said top and bottom surfaces such that said top edge coincides with said top surface front edge and said bottom edge coincides with said bottom surface front edge said front face forming a face angle with said bottom surface, said face angle ranging from 30° to 75°;

a pair of sidewalls extending rearwardly from said pair of side edges and between said top and bottom surfaces; and connection means for connecting adjacent modules in a row together and adjacent rows of modules together and for providing each row of modules to be set back from its adjacent lower row such that when so assembled, the modules form an embankment wall having a slope angle ranging from 30° to 75° relative to the horizontal.

16. The module of claim 15 used to form an embankment wall having a substantially continuous wall face forming said slope angle.

17. The module of claim 16 wherein said slope angle and said face each range from 30° to 60°.

18. The module of claim 16 wherein, when used with other modules to form a row and a plurality of rows, said front face top edge mates with the bottom edge of modules in the adjacent higher row, said front face bottom edge mates with the top edge of modules in the adjacent lower row and said front face side edges mate with side edges of adjacent modules in the same row to form said substantially continuous wall face.

19. A precast construction module to be used with a plurality of other said modules to form a row and a plurality of said rows to form an embankment wall having a slope angle ranging from 30° to 75° relative to the horizontal, said module comprising:

spaced top and bottom surfaces each having a front edge and a rear edge;

a front face having top and bottom edges and a pair of side edges and said front face extending between said top and bottom surfaces such that said top edge coincides with said top surface front edge and said bottom edge coincides with said bottom surface front edge;

a rearward end extending between said top and bottom surfaces at the rear edges thereof;

a pair of sidewalls extending rearwardly from said pair of side edges and between said top and bottom surfaces to said rearward end;

said module having a longitudinal axis extending from said front face to said rearward end and further including a head portion having a first dimension measured in a direction perpendicular to said longitudinal axis and defined in part by said top and bottom surfaces and said front face, a tail portion having a first dimension measured in a direction perpendicular to said longitudinal axis and defined in part by said top and bottom surfaces and said rearward end and a neck portion having a first dimension measured in a direction perpendicular to said longitudinal axis and positioned between said head and tail portions wherein said first dimension of said neck portion is less than said first dimension of said tail portion and said first dimension of said neck portion plus said first dimension of said tail portion is greater than said first dimension of said head portion; and connection means for connecting adjacent blocks in a row together and adjacent rows of blocks together and for providing each row of blocks to be set back from its adjacent lower row a set back distance, said set back distance being sufficient to form an embankment wall, when assembled, with a slope angle ranging from 30° to 75°.

20. The module of claim 19 wherein said first dimension of said neck portion is less than one-half said first dimension of said head portion.

21. The module of claim 19 wherein said sidewalls include sidewall portions adjacent to said side edges of said front face, said sidewall portions being parallel to one another.

22. The module of claim 21 wherein said sidewall portions extend rearwardly from said side edges a distance sufficient to be partly covered by a module in an adjacent upper row when assembled.

23. The module of claim 19 wherein said tail portion has a second dimension measured in a direction parallel to said longitudinal axis and wherein said second dimension of said tail portion is less than said set back distance.

24. An embankment wall structure comprising:

a wall having a lower end supported on a support surface, said wall extending upwardly from said support surface and having a substantially continuous wall face forming a slope angle with the horizontal of less than 90°;

said wall formed of a plurality of modules arranged in a plurality of horizontal rows positioned one on top of the other as said wall extends upwardly from said support surface, with each row having a plurality of modules and each row being in set back position relative to an adjacent lower row to provide said slope angle; and each of said modules including spaced top and bottom surfaces each having a front edge, a front face having top and bottom edges and extending between said top and bottom surfaces such that said top edge coincides with said top surface front edge and said bottom edge coincides with said bottom surface front edge, said front face forming a face angle with said bottom surface such that when said plurality of modules are arranged in a plurality of rows positioned one on top of the other in said set back position, said front faces of modules in adjacent rows mate with each other to form said substantially continuous wall face at said slope angle.

25. The wall structure of claim 24 wherein said face angle approximates said slope angle.

26. The wall structure of claim 25 wherein said top and bottom surfaces are substantially parallel throughout the entirety of said module.

27. The wall structure of claim 24 wherein said front face includes a pair of side edges and wherein said side edges mate with the side edges of adjacent modules in each row to form said substantially continuous wall face.

28. The wall structure of claim 24 having a slope angle ranging from 30° to 75°.

29. The wall structure of claim 24 having interlock means to interlock said plurality of modules and said plurality of rows in said set back position.

30. A water control channel comprising a pair of opposed and horizontally spaced side walls, each comprised of a wall structure of claim 24 and each sloping away from one another as they extend upwardly.

* * * * *